United States Patent [19]

Alexander

[11] 4,030,610

[45] June 21, 1977

[54] HANGING FILE FRAME WITH RESILIENT CORNER MEMBERS

[75] Inventor: Robert L. Alexander, Erlanger, Ky.

[73] Assignee: Hunt Manufacturing Co., Philadelphia, Pa.

[22] Filed: Aug. 25, 1975

[21] Appl. No.: 607,346

[52] U.S. Cl. ..... 211/182; 211/162; 211/189; 312/184

[51] Int. Cl.² ..... B42F 17/08

[58] Field of Search ..... 211/182, 183, 113, 184, 211/162, 189; 312/183, 184; 403/172, 176, 217, 225, 223; 46/29

[56] References Cited

UNITED STATES PATENTS

| | | | |
|---|---|---|---|
| 1,446,868 | 2/1923 | Baker | 46/29 |
| 2,239,483 | 4/1941 | Cocks | 211/126 |
| 2,329,201 | 9/1943 | Jonas | 312/184 |
| 2,803,088 | 8/1957 | Swann | 46/29 X |
| 2,956,705 | 10/1960 | Clingman | 403/172 X |
| 3,138,398 | 6/1964 | Silverman | 211/182 X |
| 3,295,697 | 1/1967 | Patterson | 312/184 X |
| 3,860,119 | 1/1975 | Irvine et al. | 211/189 X |

FOREIGN PATENTS OR APPLICATIONS

| | | | |
|---|---|---|---|
| 765,510 | 6/1934 | France | 312/184 |
| 791,837 | 3/1958 | United Kingdom | 312/184 |

*Primary Examiner*—Roy D. Frazier
*Assistant Examiner*—Robert W. Gibson, Jr.
*Attorney, Agent, or Firm*—Smith, Harding, Earley & Follmer

[57] ABSTRACT

A hanging file frame comprises a pair of elongate support rails adapted for hanging suspension file folders therefrom, a pair of transverse interconnecting members, four support legs and four resilient corner fittings for easily joining the rails, interconnecting members and legs into a rigid, parallelepiped file supporting structure wherein the support rails are maintained in mutually spaced, parallel and elevated relationship. The corner fittings, constructed of a strong plastic such as nylon or Delrin, may be molded or extruded. The transverse interconnecting members and the legs are formed of elongate cylindrical rods, end portions of which have radial projections for releasably retaining the members and legs in recesses formed in the corner fittings. The support rails are constructed of metal bars having a rectangular cross section. Support rail receiving slots, having a slightly smaller cross section than that of the rails, are formed in the corner fittings at right angles to the recesses for receiving the interconnecting members and legs, the resiliency of the fitting material permitting deflection of portions of the slot wall for rail insertion and for thereafter causing retention of the rail in the slot.

19 Claims, 15 Drawing Figures

HANGING FILE FRAME WITH RESILIENT CORNER MEMBERS

BACKGROUND OF THE INVENTION

1. Field of the Invention

This invention relates to assembleable hanging or suspension file folder support frames and, more particularly, to such frames having corner members or fittings for interconnecting the file support rails and other elements of such frames into a rigid structure.

2. Description of the Prior Art the slot. Such installation is accomplished

Hanging or suspension type file folder systems, in constrast to systems in which file folders merely rest upon the bottom of a file drawer, have been in use for a number of years. These systems employ some type of support frame having a pair of mutually spaced, parallel and elevated side rails from which pocket-type suspension file folders are hung by file folder cross members adapted for resting upon, and sliding along, the rails.

To be of practical value, the support frames must permit shipment and storage in compact, knock-down form and must be capable of easy and rapid assembly into a rigid structure for use. To fit a file drawer without diminishing the space therewithin and so that they may be removed therefrom if desired, the frames must also be capable of easy disassembly.

Various types of suspension file frames have been disclosed, including those of Irvine et al, Woodhouse, Carter, Jonas, Posner, Conley et al, Patterson et al, Peebles, West et al and Filipowski (U.S. Pat. Nos. 3,860,119; 3,356,228; 3,734,300 and 3,651,950; 2,278,403; 2,336,802; 2,810,388; 2,852,028; 3,208,456; 3,266,496 and 3,853,277 respectively). There are also various foreign disclosures, including those of Harwood-Jones (British Pat. No. 791,837), Posner (British Pat. No. 737,226), Markum (British Pat. No. 968,265), Posner (Canadian Pat. No. 518,582), Robert (French Pat. No. 1,136,114) and Lampel (French Pat. No. 1,167,660).

In spite of the number and variety of disclosures pertaining to hanging file folder support structures, none provide entirely satisfactory solutions to problems relating to ease and economy of construction and assembly, and to strength and rigidity of the structure connecting joints. All such problems must be resolved to achieve a truly satisfactory and commercially successful structure. The number and variety of disclosures in this field indicate that constant improvements in design and construction of the suspension file support frames are continually needed and sought.

SUMMARY OF THE INVENTION

A hanging file support frame in accordance with the invention comprises a pair of elongate support rails adapted for suspending file folders therefrom and means for maintaining the support rails in mutually spaced, parallel relationship and in an elevated condition, to enable hanging of the file folders therefrom, such means including a pair of transverse interconnecting members, a plurality of supporting legs and four corner fittings for joining the interconnecting members, support rails and legs into a rigid file supporting frame. The corner fittings, constructed of a strong resilient material, are formed with recesses for receiving end portions of the interconnecting members and legs and with an opening for receiving end portions of the support rails.

More specifically, the transverse interconnecting members and legs are formed of elongate rods having radial end projections for releasably retaining the members and legs in corresponding corner fitting recesses. The side rails are of rectangular cross section and may be provided with a plurality of spaced, transverse notches or break lines at an end region to provide for convenient length reduction of the rails. An elongate slot having a cross section slightly smaller than that of the support rails is formed in each corner fitting for receiving an end portion of a support rail. The axis of the slot is at a right angle to the axes of the recesses for the interconnecting members and legs. An opening formed in a side wall of the rail receiving slot provides for snapping a rail end portion sideways into the slot, the resiliency of the fitting permitting slot wall portions to yield to enable such side insertion and thereafter releasably retaining the rail end portion in the slot.

In a first variation fitting, the rail receiving slot is formed without wall openings, a rail end portion being axially inserted into the slot and being releasably held therein by the resiliency of the material. In a second variation fitting, an opening formed in a top portion of the slot permits a rail end portion to be snapped downwardly into the slot. In a third variation fitting, similar to the second, a thin extension of one of the slot side walls is bendable downwardly over the top of a downwardly installed rail end portion, a projecting portion of the extension engaging a receiving portion of the fitting to releasably lock the rail end portion into the slot. A fourth variation fitting is generally cubical in shape and has a side slot opening for sideways insertion of a rail end portion into the rail receiving slot. Each support leg associated with the fourth variation is formed from an elongate bar and has a vertical portion received by a corner fitting, a bent-over horizontal lower supporting portion and an upwardly directed portion having an aperture for receiving therethrough one of the transverse interconnecting members.

A fifth variation frame employs a pair of U-shaped legs and corner fittings having splined, interference-fit interconnecting member and leg receiving recesses. A slot found at right angles to the rail receiving opening enhances the cantilever beam action, or springiness, of upper portions of the fitting. A beveled lower inner portion of the fitting, adjacent to the rail receiving opening facilitates side insertion of the rail into the opening.

The corner fittings of the preferred embodiment and variations thereof are easily and economically formed from a strong plastic such as nylon or Delrin and provide for quick and easy assembly of the structure parts into a rigid, yet easily disassembled, suspension file support frame. An additional advantage of such corner fittings is that sharp corners of the supporting structure are substantially eliminated to prevent injury to the user.

BRIEF DESCRIPTION OF THE DRAWINGS

A better understanding of the present invention may be had from a consideration of the following detailed description, taken in conjunction with the accompanying drawings in which.

DESCRIPTION OF THE PREFERRED EMBODIMENT

Figure 1:
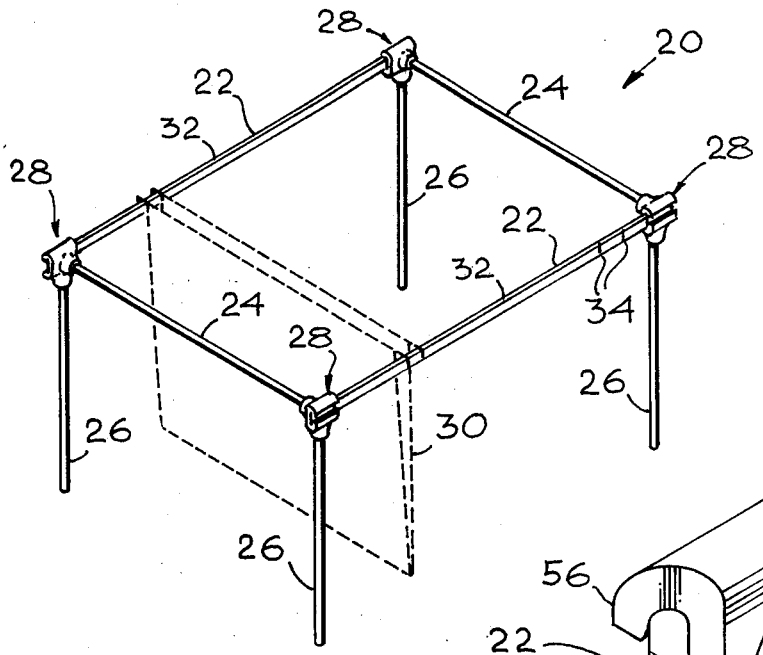
FIG. 1 is a perspective view showing an assembled hanging file support frame in accordance with the invention.

As seen in FIG. 1, a hanging or suspension file folder support frame 20 comprises a pair of file support rails 22, a pair of transverse interconnecting members 24 and four support legs 26. A resilient or elastomeric corner member or fitting 28, provided at each upper corner of the frame 20, joins the rails 22, the transverse interconnecting members 24 and the legs 26, as more particularly described below, into a rigid, rectangular parallelepiped structure in which the rails 22 are disposed in mutually spaced parallel relationship. The members 24 space the rails an appropriate distance apart so that a conventional suspension file 30, which may be of "standard" or legal size, may be supported from upper rail surfaces 32 and the legs 26 support the rails at an elevation enabling free hanging of the files 30 from the rails.

To provide for adapting the frame 20 to file drawers, desk drawers, etc. of different length, the rails 22 are provided, at least at one end portion, with a plurality of spaced notches or grooves 34 along the height of the rail for easy breaking therealong to shorten the rails in an incremental fashion.

The rails 22 are generally rectangular in cross section and are preferably constructed of an inexpensive, rigid metal, such as that commonly referred to as "grey metal." The transverse members 24 and the legs 26 may be constructed of a cylindrical rod of material similar to that used for the rails 22 or, alternatively, may be constructed of comparatively strong rigid plastic or other material.

Figure 2:
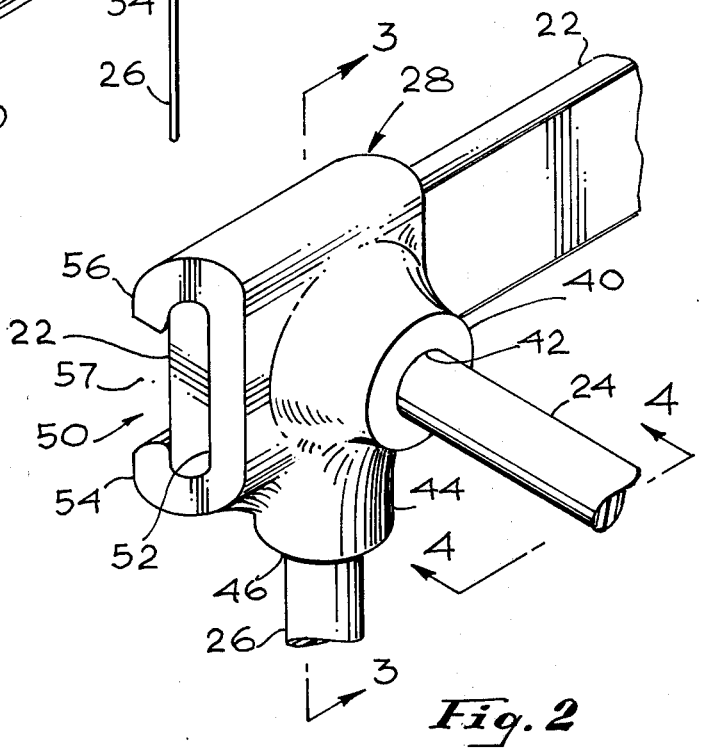
FIG. 2 is a perspective view, showing a corner fitting of the file support frame.
Figure 3:
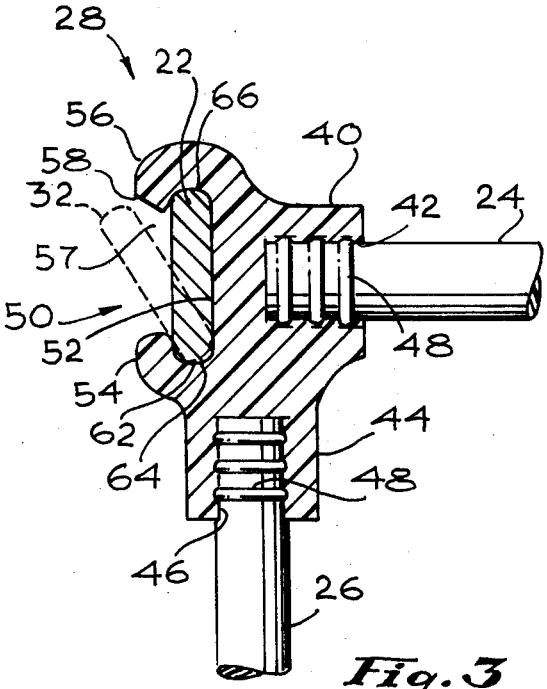
FIG. 3 is a vertical sectional view along line 3—3 of FIG. 2, showing a typical installation of a file support rail into a corner fitting.
Figure 4:
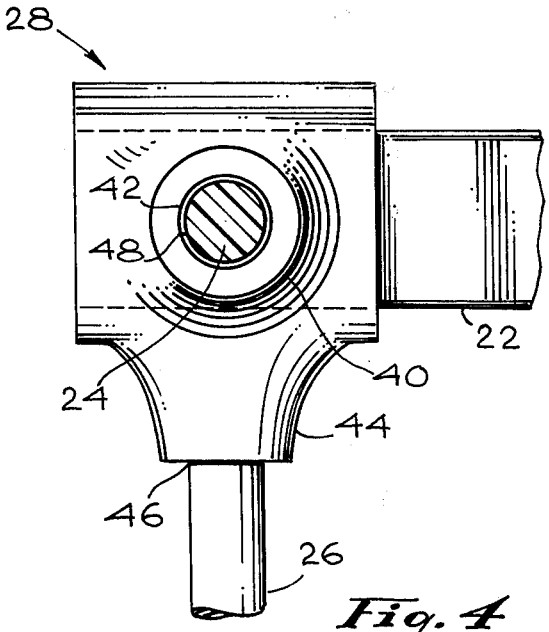
FIG. 4 is a view along line 4—4 of FIG. 2, showing a rear portion of a corner fitting.

As shown in FIGS. 2–4, the corner fitting 28 comprises a small, three-dimensional structure molded from a strong, resilient or elastomeric plastic such as nylon or Delrin (an acetal resin available from E. I. Dupont de Nemours & Co.). To receive an outer end of the transverse member 24, the fitting 28 is formed with an inwardly projecting boss or portion 40 having a cylindrical recess 42 therein. For receiving the upper end of the leg 26 a depending boss or portion 44 is formed having therein a cylindrical recess 46. Axes of the recesses 42 and 46 are at right angles and lie in a common plane (FIGS. 3 and 4).

End portions of the transverse interconnecting member 24 and the leg 26 have a plurality of protrusions or annular teeth 48 radially projecting therefrom, which, when such ends are forced into their respective fitting recesses 42 or 46, releasably retain the member and leg within the fitting, yet still allow them to be pulled loose therefrom for subsequent disassembly.

Formed along a portion of the fitting 28 opposite to the boss 40 and perpendicular to the axes of the recesses 42 and 46 is an elongate slot or opening 50 which comprises an inner vertical wall portion 52 having an outwardly and upwardly curved lower portion 54 and an outwardly and downwardly curved upper portion 56, and which is therefore formed having a side opening 57. The cross section of the slot 50 is formed similar to, but slightly smaller than, the cross section of the end portion of the rail 22, and has the major cross sectional axis vertically disposed. An exposed edge 58 of the upper portion 56 is chamfered or rounded so that, as depicted in FIG. 3, slot. Such installation is accomplished rail 22 may be forced or snapped sideways through the side opening 57 into the accomplished by first placing a lower surface 62 of the rail 22 into contact with a lower inner mating surface 64 of the lower portion 54 (such initial position of the rail 22 being indicated by dashed lines in FIG. 3), and by then twisting upper portions of the rail inwardly toward the fitting 28 so that the upper rail surface 32 slides through the side opening 57 and past beveled edge 58, causing the portion 56 to momentarily deflect upwardly, thereby snapping the rail 22 into the slot 50. Once installed in this manner, the resiliency of the fitting 28 releasably secures or locks the rail 22 within the slot 50, with an upper, inner fitting surface 66 bearing against the upper rail surface 32 and the lower inner fitting surface 64 bearing against the lower rail surface 62, and with part of the portions 56 and 58 projecting partially around an outside rail surface. However, the rail 22 may be removed from the fitting 28 by reversing the above described installing procedure. By this means, the suspension file support rails 22 are firmly, yet removably, retained in an appropriate file supporting configuration by the four corner fittings 28 (and members 24 and legs 26), without the need for additional clamping, screwing, locking, etc.

Figure 5:
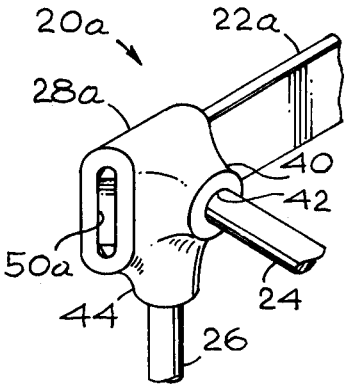
FIG. 5 is a perspective view of a first variation of the corner fitting.
Figure 6:
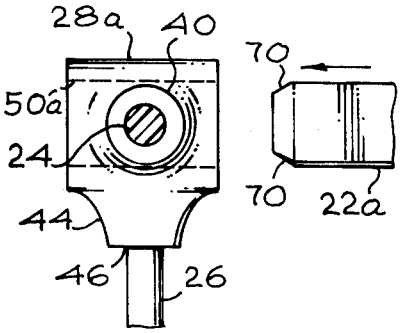
FIG. 6 is a right-hand elevation in partial section of the fitting of FIG. 5, showing typical installation of a file support rail into the first variation corner fitting.

In a first variation, illustrated in FIGS. 5 and 6, the frame 20*a* employs four corner fittings 28*a* which are entirely similar to the above-described fittings 28 except that support rail supporting slots 50*a* therein are completely closed around the sides, rather than having side openings 57, as do the slots 50 of the fittings 28, the slots 50*a* being instead adapted for axially receiving an end portion of a support rail 22*a*. For easy axial installation of the rail 22*a* into the fitting slot 50*a*, rail end corners 70 are beveled or rounded. Resiliency of the fitting 28*a* permits the slot 50*a* to expand slightly to accommodate the rail 22*a*, and thereafter releasably retains the rail therewithin. As above described, a boss 40, having a cylindrical recess 42 is provided in the fitting 28*a* for receiving an end of the transverse interconnecting member 24; a vertical boss 44, having a cylindrical recess 46, is provided for receiving an upper end of the leg 26. Assembly of the file support frame 20*a* is thereby accomplished in the manner shown in FIG. 1 for the frame 20.

Figure 7:
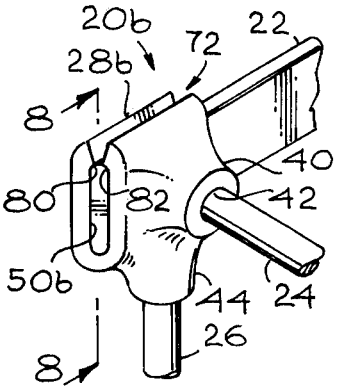
FIG. 7 is a perspective view, showing a second variation of the corner fitting.
Figure 8:
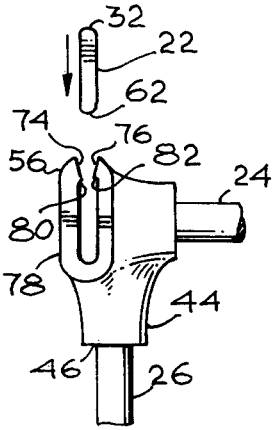
FIG. 8 is a view along line 8—8 of FIG. 7, showing typical installation of a file support rail into a second variation corner fitting.

A second variation frame 20*b*, according to FIGS. 7 and 8, includes corner fittings 28*b*, which are similar to the fittings 28 and 28*a* described above, except that a top portion of the upper portion 56 has been cut away, forming a narrow opening 72, to provide vertical entry of the rail end portion to the slot 50*b*. Exposed edges 74 and 76, adjacent the opening 72, are sloped or beveled inwardly to allow the lower edge 62 of the rail 22 to be easily installed through the opening 72 and into the slot 50*b* for assembly of the rail into the fitting, an outer, vertical slot wall portion 78 being caused to flex outwardly during the assembly. Inwardly projecting, opposing lower corners 80 and 82, respectively, of the surfaces 74 and 76 project over the upper edge 32 of the rail 22 when the rail is fully received into the slot 50*b*, and thereby releasably retain the rail in the slot. The rail 22 may be removed from the slot 50*b* by pulling it upwardly through the opening 72. The transverse connecting member 24 and the legs 26 are received within the fitting 28 in, respectively, bosses 40 and 44, in the above-described manner.

Figure 9:
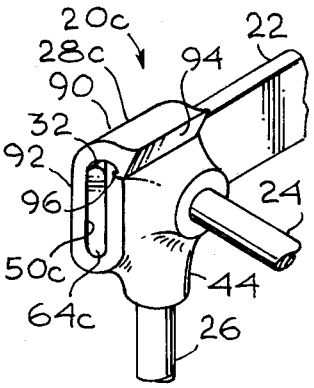
FIG. 9 is a perspective view, showing a third variation of the corner fitting.
Figure 10:
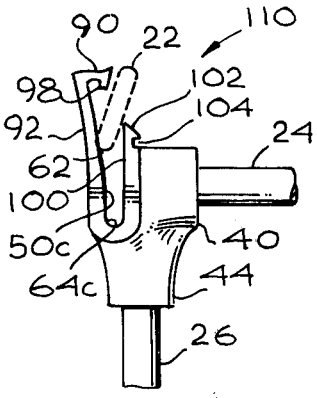
FIG. 10 is a front elevation view of the fitting of FIG. 9, showing typical installation of a file support rail into the third variation corner fitting.

FIGS. 9 and 10 illustrate a third variation frame 20*c* in which corner fittings 28*c* have a rail receiving slot 50*c* which is closable (FIG. 9) by an elongate flexible extension 90 of an outer wall portion 92. The extension 90 has an inwardly directed flange 94 formed with a downwardly directed lip 96 having an inwardly directed hook portion 98. Opposite the wall portion 92, a short inner wall portion 100, having an arcuate outer (in respect to the slot 50*c*) surface 102, is formed. Below the surface 102 is a groove or notch 104, constructed to receive the hook portion 98 of the extension 90.

For receiving the rail 22 into the slot 50*c*, (FIG. 10) the extension 90 is maintained in an open, unbent condition, an opening 110 thereby being defined, between the extension 90 (and wall portion 92) and the inner wall portion 100, into the slot 50*c*. When the rail 22 is inserted downwardly through the opening 110 into the slot 50*c*, so that the lower surface 62 of the rail 22 rests upon a bottom surface 64*c* of the slot, the extension 90 is bent inwardly and then downwardly over the upper surface 32 of the rail until the hook portion 98 engages the groove 104 of the wall portion 100, thereby releasably locking the rail into the slot, the resiliency of the fitting material providing for clamping the rail against movement (FIG. 9). To release the rail 22 from the fitting 28*c*, the hook portion 98 is disengaged from the groove 104, the extension 90 being thereby allowed to resume its initial configuration. The rail 22 is then withdrawn through the opening 110.

A fourth variation frame 20*d* (FIGS. 11 and 12) includes four corner fittings 28*d*, which are entirely similar to the above-described fittings 28 (FIGS. 2–4) except that the fittings 28*d* are constructed in a generally cubical shape. The transverse member 24 is received into a cylindrical recess 42 and an elongate, open slot 50*d* is formed for receiving the rails 22.

Figure 11:
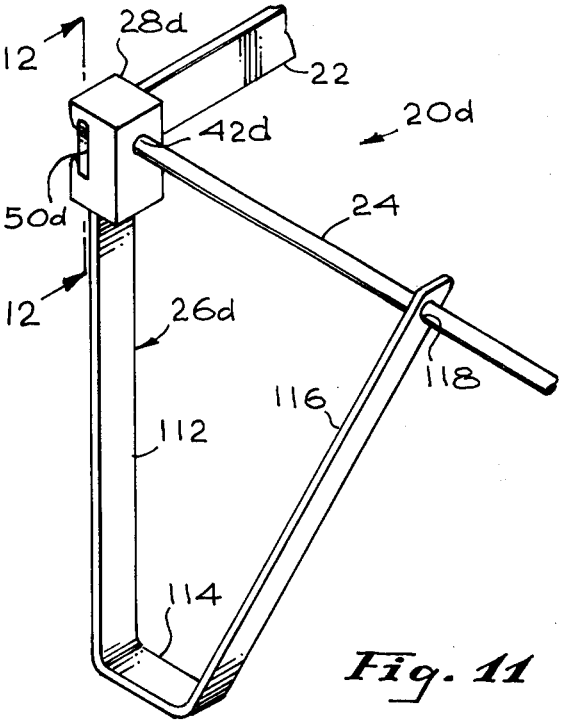
FIG. 11 is a perspective view, showing a fourth variation of the corner fitting and a variation of the support legs used therewith.
Figure 12:
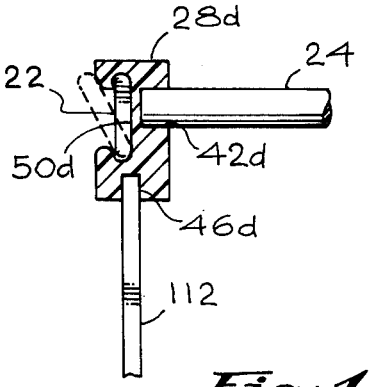
FIG. 12 is a sectional view along line 12—12 of FIG. 11, showing typical installation of a file support rail into a fourth variation corner fitting.

A variation of the above-described leg 26 is also depicted in FIGS. 11 and 12, a leg 26*d* being shown which is bent from an elongate flat bar to have a vertical attaching portion 112, a lower horizontal support 114 (adjacent the bottom of the vertical portion) and an upwardly inclined end portion 116. An upper end of the vertical leg portion 112 is received in a vertically disposed recess 46*d* formed in the bottom of the fitting 28*d*. An aperture 118, at the upper end of the leg portion 116, receives the transverse connecting member 24 upon installation thereof to provide rigidity to the frame. The leg 26*d*, formed in the general shape of a V with a truncated apex, may be constructed of the same material as the rails 22 or of any other suitable, strong rigid material.

Figure 14:
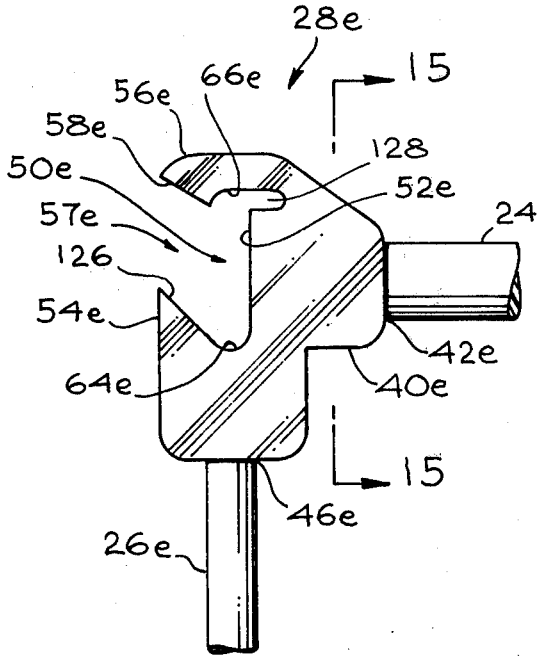
FIG. 14 is an enlarged elevational view of the corner fitting shown in FIG. 13.
Figure 15:
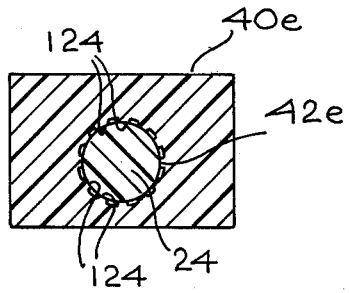
FIG. 15 is a vertical section taken on the plane indicated by the line 15—15 in FIG. 14.
Figure 13:
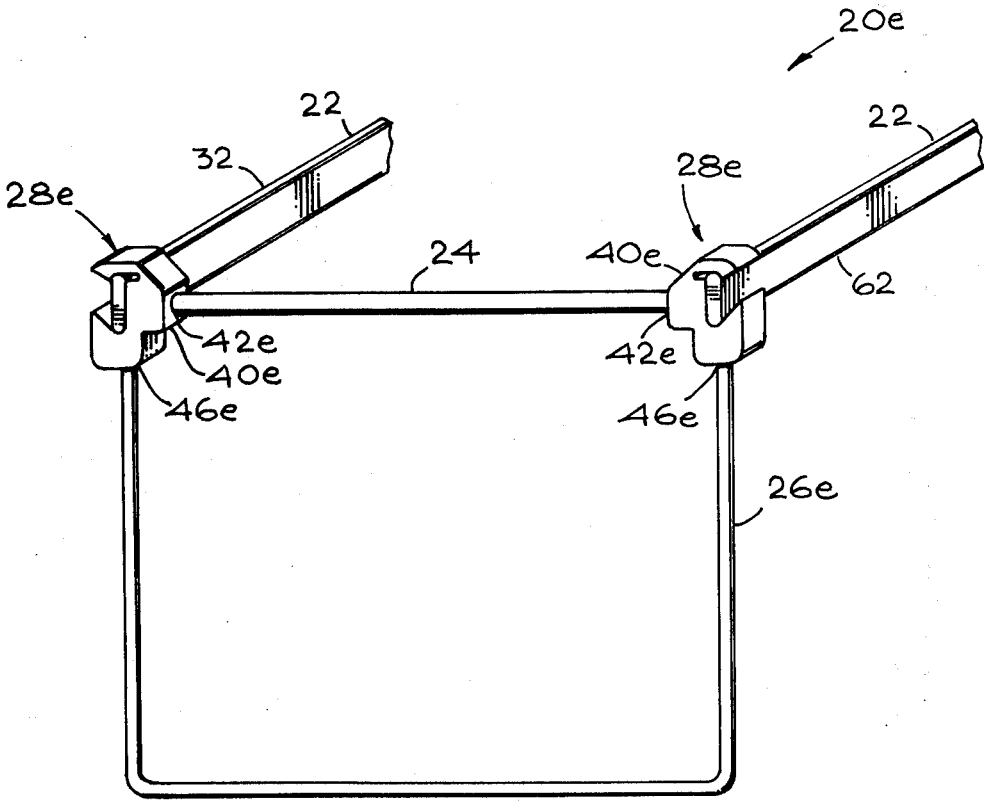
FIG. 13 is a perspective view, partially broken away, showing a fifth variation of the corner fitting and a variation of the support legs used therewith.

FIGS. 13–15 illustrate a fifth variation frame 20*e*, having four corner fittings 28*e* which are similar to the above-described corner fittings 28 and 28*d*, except for differences described below. As seen in FIG. 13, the frame 20*e* employs a U-shaped suport leg 26*e* formed so that one vertical end portion thereof is received in a recess 46*e* of one fitting 28*e* and the other vertical end portion of the leg is similarly received in a recess of 46*e* of an opposing fitting 26*e*. The transverse interconnecting member 24 is received in apertures 42*e* formed in inwardly directed bosses 40*e* of the fittings 28*e* (see also FIG. 14).

Instead, however, of the recesses 42*e* and 46*e* being formed with smooth walls, as above-described for the recesses 42–42*d* and 46–46*d*, such recesses of the corner fittings 28*e* are formed as a circumferential bore with a plurality of inwardly directed elements as departures from the circular outline of the bore. These elements are shown in FIG. 15 as axial projections or splines 124 which project inwardly toward the axis of the recess (as shown in FIG. 15 for the recess 42*e*). The inner diameter of the recesses 42*e* and 46*e*, as defined by inwardly projecting ends of the splines 124, is slightly smaller than the outside diameter of the leg 26*e* and the interconnecting member 24 to provide an interference fit. On installation of the leg 26*e* and the member 24 into their respective recesses 46*e* and 42*e*, the splines 124 deform to securely, yet releasably, retain the leg and the interconnecting member in the fitting 28*e*.

An opening 50*e*, formed for receiving a rail 22 through a side entry 57*e* thereof, is formed similarly to the opening 50 above described for the corner fitting 28, except that an inner surface 126 of the lower opening portion 54*e* is inwardly beveled adjacent the opening 50*e* to provide easy installation of the rail 22. An inwardly directed groove or slot 128 is formed at the top of the rear wall 52*e*, adjacent to its intersection with a surface 66*e* and at right angles to the opening 50*e*. Because of the groove 128, increased cantilever or overhanging beam action—that is, increased springiness—is provided to the upper portion 66*e*, thereby facilitating installation of the rail 22 into the opening 50*e* and helping retain it therein. As was the case with the fitting 28, a surface 58*e* at the end of an upper portion 56*e* is beveled, a lower portion thereof projecting downwardly to retain the rail in position.

The corner fitting 28*e*, like the above-described fittings 28–28*d*, may be formed of a plastic such as nylon or Delrin. Any of the described fittings 28–28*e* may, however, be constructed of other materials having resilient properties, such materials including metals such as aluminum which may be in stamped, cast, machined, or extruded form.

Although there have been described above specific arrangements of the hanging file support frame and of corner fittings therefor in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. A hanging file folder support frame, which comprises:

a. a pair of elongate file folder support rails adapted for suspending hanging file folders from upper surfaces thereof, and b. means for maintaining said support rails in a mutually spaced relationship and at an elevation to enable suspension of hanging file folders therefrom, said maintaining means including a pair of transverse interconnecting members, a plurality of supporting legs and four corner fittings, said corner fittings being formed of strong resilient material and being constructed to receive end portions of said transverse interconnecting members and upper end portions of said supporting legs, and for releasably receiving end portions of said rails, whereby a generally rectangular, rigid parallelepiped file support frame is formed with said rails at an uppor portion thereof, and each of said corner fittings having wall portions defining an opening into which an end portion of one of the rails is installed and defining an entry into said opening for the passage of the rail into the said opening in a direction transverse to the length of the rail and the portions of the walls adjacent said entry include locking portions disposed over corresponding portions of said rail end portion when the rail end portion is installed in said opening, whereby to releasably lock the rail end portion into the opening, said locking portions being flexible sufficiently to permit entry of the rail end portion into, and removal of the rail end portion from, the opening.

2. The frame as claimed in claim 1, wherein end portions of said transverse interconnecting members and upper end portions of said supporting legs are adapted to be received in recesses formed in said corner fittings.

3. The frame as claimed in claim 2, wherein said end portions of said transverse interconnecting members and said upper end portions of said supporting legs are formed with a plurality of outwardly directed projections for causing releasable locking of said end portions in said corner fitting recesses.

4. The frame as claimed in claim 2, wherein said recesses are axially splined, the inside diameter of the splines being slightly smaller than the outside diameter of the end portions of the interconnecting members and the supporting legs, whereby an interference fit is provided, the splines being caused to deform when said end portions are installed in the recesses.

5. The frame as claimed in claim 1, wherein one of said supporting legs is associated with each one of said corner fittings, and wherein at least portions of said supporting legs adjacent said fittings are vertically disposed.

6. The frame as claimed in claim 5, wherein each of said supporting legs is formed having an upwardly directed, non-fitting mounting portion, said upwardly directed portion having an aperture through which one of the transverse interconnecting members is installed.

7. The frame as claimed in claim 1, wherein a pair of supporting legs are provided, each supporting leg being formed in a generally U-shape, two of said corner fittings being associated with each of said legs.

8. The frame as claimed in claim 1, wherein said support rails are generally rectangular in cross section.

9. The frame as claimed in claim 8, wherein said support rails include a plurality of spaced grooves for enabling incremental rail portions, at least at one end portion thereof, to be broken off, whereby the rails may be easily shortened to adapt to different lengths of frame containing structures.

10. The frame as claimed in claim 1, wherein said wall portions define a top entry into said opening, said wall portions including front and back opening walls, whereby said rail end portions may be inserted downwardly into the opening.

11. The frame as claimed in claim 10, wherein said front and back walls include means for locking said rail end portion in the opening.

12. The frame as claimed in claim 11, wherein said means for locking comprises an extension portion formed on one of said front and rear walls and having portions bendable downwardly over an upper surface of a rail end portion installed in said opening, and the other of the front and rear opening walls includes retaining means for retaining said bendable portion.

13. The frame as claimed in claim 1, wherein said corner fittings have the general properties of nylon.

14. The frame as claimed in claim 1, wherein said corner fittings have the general properties of Delrin.

15. The frame as claimed in claim 1, wherein said corner fittings are generally cubical in shape.

16. The frame as claimed in claim 1, wherein said corner fittings are of molded construction.

17. A hanging file folder support frame, which comprises:

a. a pair of elongate file folder support rails adapted for suspending hanging file folders from upper surfaces thereof, and b. means for maintaining said support rails in a mutually spaced relationship and at an elevation to enable suspension of hanging file folders therefrom, said maintaining means including a pair of transverse interconnecting members, a plurality of supporting legs and four corner fittings, each of said corner fittings being formed of strong resilient material and being constructed to receive end portions of said transverse interconnecting members and upper end portions of said supporting legs, and each of said corner fittings having wall portions defining an opening into which an end portion of one of the rails is installed and defining a side entry into said opening whereby said rail end portions may be inserted sideways into the opening, the portions of the walls adjacent said side entry including locking portions disposed over corresponding portions of said rail end portions when the rail end portion is installed in said opening, whereby to releasably lock the rail end portion into the opening, said locking portion being flexible sufficiently to permit side entry of the rail end portion into, and removal of the rail end portion from, the opening, whereby a generally rectangular, rigid parallelepiped file support frame is formed with said rails at an upper portion thereof.

18. The frame as claimed in claim 17, wherein said opening adjacent at least one of said locking portions and away from said side entry is slotted at right angles to said opening, whereby to enhance the overhanging beam action of said one locking portion and thereby enhance the springiness thereof.

19. A hanging file folder support frame, which comprises:

a. a pair of elongate file folder support rails adapted for suspending hanging file folders from upper surfaces thereof, and b. means for maintaining said support rails in a mutually spaced relationship and at an elevation to enable suspension of hanging file folders therefrom, said maintaining means including a pair of transverse interconnecting members, a plurality of supporting legs and four corner fittings, each of said corner fittings being formed of strong resilient material and being constructed to receive end portions of said transverse interconnecting members and upper end portions of said supporting legs, and for releasably receiving end portions of said rails, whereby a generally rectangular, rigid parallelepiped file support frame is formed with said rails at an upper portion thereof, and each of said corner fittings having wall portions defining an opening into which an end portion of one of the rails is installed and defining a side entry into said opening whereby said rail end portions may be inserted sideways into the opening, one of said wall portions defining the side entry into said opening being beveled on a side adjacent said opening, whereby an end portion of said rail may be easily inserted into said opening.

* * * * *

UNITED STATES PATENT OFFICE

CERTIFICATE OF CORRECTION

Patent No. 4,030,610 Dated June 21, 1977

Inventor(s) Robert L. Alexander

It is certified that error appears in the above-identified patent and that said Letters Patent are hereby corrected as shown below:

In the subheading 2. commencing at line 12 of column 1, delete "the slot. Such installation is accomplished".

In column 1 at line 36, correct patent number "3,853,277" to read "3,853,227", and in line 42 correct French patent number "1,167,660" to read "1,168,660".

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*